US008678946B2

(12) United States Patent
Boyd et al.

(10) Patent No.: US 8,678,946 B2
(45) Date of Patent: Mar. 25, 2014

(54) GOLF CLUB ASSEMBLY AND GOLF CLUB WITH AERODYNAMIC FEATURES

(75) Inventors: Robert Boyd, Euless, TX (US); John T. Stites, Weatherford, TX (US); Gary G. Tavares, Southbridge, MA (US)

(73) Assignee: NIKE, Inc., Beaverton, OR (US)

( * ) Notice: Subject to any disclaimer, the term of this patent is extended or adjusted under 35 U.S.C. 154(b) by 231 days.

(21) Appl. No.: 13/159,913

(22) Filed: Jun. 14, 2011

(65) Prior Publication Data

US 2012/0322573 A1 Dec. 20, 2012

(51) Int. Cl.
*A63B 53/04* (2006.01)

(52) U.S. Cl.
USPC ..... 473/327; 473/328

(58) Field of Classification Search
USPC ..... 473/324–350, 287–292; D21/733, 752
See application file for complete search history.

(56) References Cited

U.S. PATENT DOCUMENTS

| | | | | | |
|---|---|---|---|---|---|
| 4,260,157 | A | * | 4/1981 | Jones et al. | 473/165 |
| D275,412 | S | * | 9/1984 | Simmons | D21/752 |
| 4,754,974 | A | | 7/1988 | Kobayashi | |
| 5,092,599 | A | * | 3/1992 | Okumoto et al. | 473/327 |
| D326,885 | S | * | 6/1992 | Paul | D21/733 |
| 5,127,653 | A | * | 7/1992 | Nelson | 473/249 |
| 5,171,621 | A | * | 12/1992 | Desbiolles et al. | 428/141 |
| 5,190,289 | A | | 3/1993 | Nagai et al. | |
| 5,203,565 | A | * | 4/1993 | Murray et al. | 473/242 |
| D345,403 | S | * | 3/1994 | Sanchez | D21/752 |
| D349,934 | S | * | 8/1994 | Feche et al. | D21/733 |
| D350,580 | S | * | 9/1994 | Allen | D21/733 |
| D371,407 | S | * | 7/1996 | Ritchie et al. | D21/733 |
| 5,700,208 | A | | 12/1997 | Nelms | |
| 5,921,872 | A | * | 7/1999 | Kobayashi | 473/345 |
| 6,001,029 | A | | 12/1999 | Kobayashi | |
| 6,012,989 | A | | 1/2000 | Saksun, Sr. | |
| 6,332,848 | B1 | * | 12/2001 | Long et al. | 473/328 |
| D457,583 | S | * | 5/2002 | Olsavsky et al. | D21/752 |
| 6,776,725 | B1 | | 8/2004 | Miura et al. | |
| 7,803,065 | B2 | * | 9/2010 | Breier et al. | 473/334 |
| 2002/0077195 | A1 | | 6/2002 | Carr et al. | |
| 2008/0188320 | A1 | | 8/2008 | Kamatari | |
| 2011/0081982 | A1 | | 4/2011 | Stites | |

FOREIGN PATENT DOCUMENTS

| | | | |
|---|---|---|---|
| FR | 2782650 | A1 | 3/2000 |
| JP | 2009000281 | A | 1/2009 |

OTHER PUBLICATIONS

FastSkinz web pages: "MPG-Plus, Drag Reducing Technology, Improve MPG, Vehicle Wraps, FastSkinz", "Boundary layer, Adverse Pressure Gradient (APG), Flowfield, FastSkinz" and "Drag Terminology Defined, Laminar Air Flow, Reynolds Number, MPG-Plus, FastSkinz", printed Jun. 17, 2011. http://www.fastskinz.com (5 pages).

International Search Report & Written Opinion, dated Oct. 8, 2012, issued in the International application PCT/US2012/042120.

* cited by examiner

*Primary Examiner* — Sebastiano Passaniti
(74) *Attorney, Agent, or Firm* — Banner & Witcoff, Ltd.

(57) ABSTRACT

A golf club head includes a body member having a ball striking face, a crown, a toe, a heel, a sole, a rear and a hosel region located at the intersection of the ball striking face, the heel, the crown and the sole. A plurality of dimples are located on the hosel region, on the crown, on the sole, and/or on the heel, wherein at least some of the plurality of dimples have a major axis that is not aligned in a direction parallel to the moment-of-impact club-head-trajectory direction. A golf club including the golf club head is also provided.

32 Claims, 6 Drawing Sheets

GOLF CLUB ASSEMBLY AND GOLF CLUB WITH AERODYNAMIC FEATURES

FIELD

Aspects of this invention relate generally to golf clubs and golf club heads, and, in particular, to golf clubs and golf club heads with aerodynamic features.

BACKGROUND

The distance a golf ball travels when struck by a golf club is determined in large part by club head speed at the point of impact with the golf ball. Club head speed in turn can be affected by the wind resistance or drag provided by the club head during the entirety of the swing, especially given the large club head size of a driver. The club head of a driver, fairway wood or metal wood in particular produces significant aerodynamic drag during its swing path. The drag produced by the club head leads to reduced club head speed and, therefore, reduced distance of travel of the golf ball after it has been struck.

Reducing the drag of the club head not only at the point of impact, but also during the course of the entire downswing prior to the moment of impact, would result in improved club head speed and increased distance of travel of the golf ball. When analyzing the swing of professional golfers, it has been noted that the heel/hosel area of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. It has been noted that during a downswing, the golf club is rotated by 90° or more around the longitudinal axis of its shaft (yaw) during the 90° of downswing prior to the point of impact with the golf ball. During this same portion of the downswing, the club may be accelerated to approximately 65 miles per hour (mph) to over 100 mph, and in the case of a professional golfer, to as high as 140 mph.

Club heads that have been designed to reduce the drag of the head at the point of impact, or from the point of view of the club face leading the swing, may not function well to reduce the drag during other phases of the swing cycle, such as when the heel/hosel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

This application discloses a golf club head with improved aerodynamic performance. In accordance with certain aspects, a golf club head includes a body member having a ball striking face, a toe, a heel, a sole, a rear, and a hosel region located at the intersection of the ball striking face, the heel, the crown and the sole. A drag reducing structure on the body member is configured to reduce drag for the body member during a golf swing from an end of a backswing through a downswing.

In accordance with other aspects, a golf club head includes a body member having a ball striking face, a crown, a toe, a heel, a sole, a rear, and a hosel region located at the intersection of the ball striking face, the heel, the crown and the sole. A plurality of dimples are located in the hosel region, wherein at least some of the plurality of hosel region dimples have a major axis that is not aligned in a direction parallel to the moment-of-impact club-head-trajectory direction.

In accordance with further aspects, a plurality of dimples may be located on the crown, on the sole, and/or on the heel. At least some of the plurality of dimples may have a major axis that is not aligned in the direction parallel to the moment-of-impact club-head-trajectory direction. Optionally, at least some of the plurality of dimples may have a major axis that is not aligned in a direction perpendicular to the moment-of-impact club-head-trajectory direction.

According to even other aspects, the dimples may be raised dimples, lowered dimples and/or a combination of raised and lowered dimples. The dimples may have a depth and/or a height that ranges from approximately 0.05 mm to approximately 1.0 mm, from approximately 0.05 mm to approximately 0.20 mm, from approximately 0.10 mm to approximately 0.50 mm, and/or even from approximately 0.10 mm to approximately 0.8 mm.

In accordance with even further aspects, a golf club head includes a body member having a ball striking face, a crown, a toe, a heel, a sole, a rear and a hosel region located at the intersection of the ball striking face, the heel, the crown and the sole. A plurality of dimples is located over a majority of the surfaces of the crown, the sole and the heel. At least some of the plurality of dimples may be elongated, and/or least some of the plurality of dimples may have differing sizes.

These and additional features and advantages disclosed herein will be further understood from the following detailed disclosure of certain embodiments.

Figure 1:
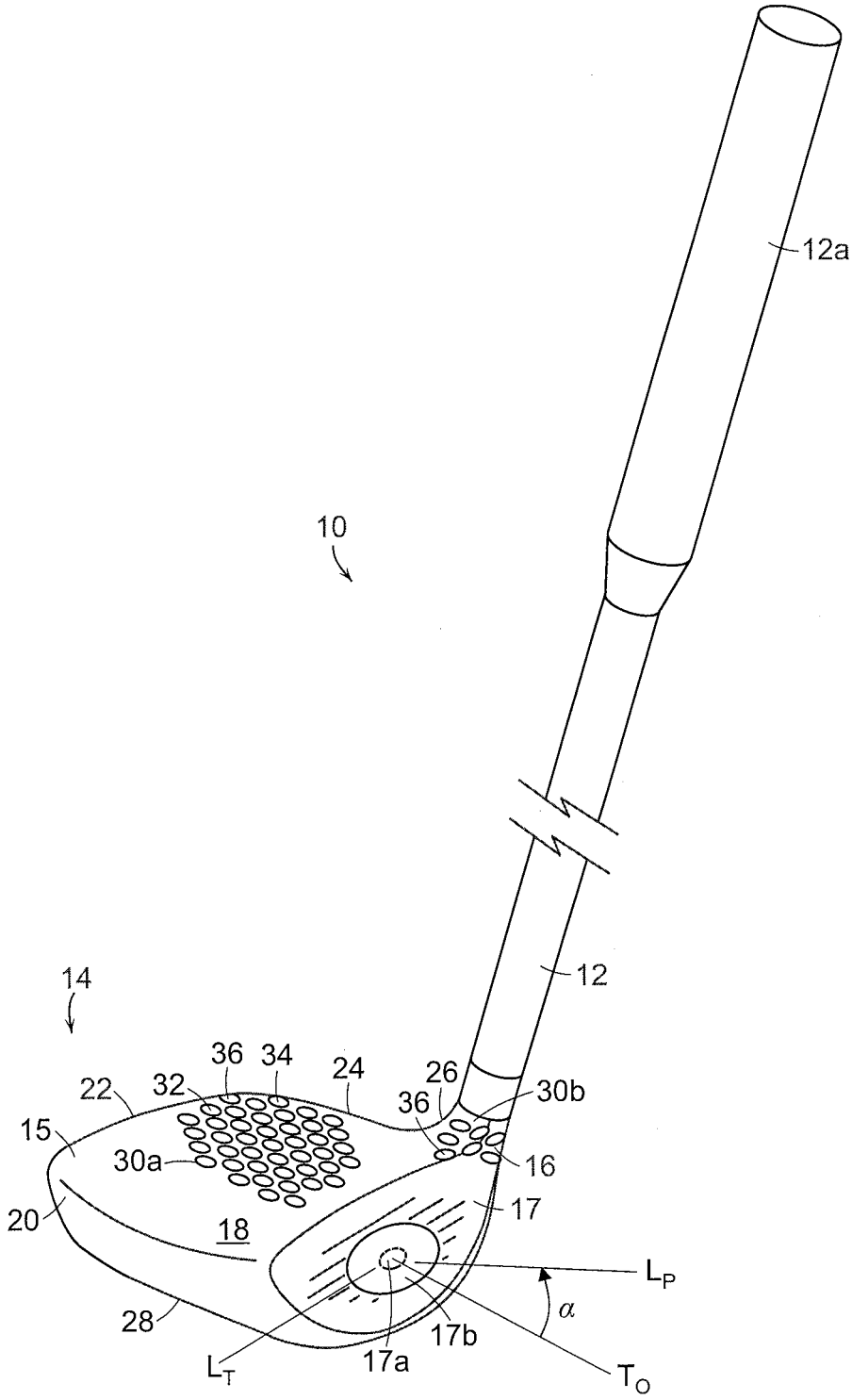
FIG. 1 is a perspective view of a golf club with at least one drag-reducing structure included on a surface of the club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

An illustrative embodiment of a golf club 10 is shown in FIG. 1 and includes a shaft 12 and a golf club head 14 attached to the shaft 12. Golf club head 14 may be any driver, wood, or the like. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 12*a* is positioned on the shaft 12 to provide a golfer with a slip resistant surface with which to grasp golf club shaft 12. The grip element 12*a* may be attached to the shaft 12 in any desired manner, including in conventional manners known and used in the art (e.g., via adhesives or cements, via threads or other mechanical connectors, via fusing techniques, via friction fits, via retaining element structures, etc.).

In the example structure of FIG. 1, the club head 14 includes a body member 15 to which the shaft 12 is attached at a hosel 16 in known fashion. The body member 15 further includes a plurality of portions or surfaces. This example body member 15 includes a ball striking face 17, a crown 18, a toe 20, a rear 22, a heel 24, a hosel region 26 and a sole 28.

The ball striking face 17 may be essentially flat or it may have a slight curvature or bow. The point of desired contact of the striking face 17 with the golf ball may be considered to be "the sweet spot" 17*a*. For purposes of this disclosure, a line $L_T$ drawn tangent to the surface of the striking face 17 at the sweet spot 17*a* defines a direction parallel to the ball striking face 17. The family of lines drawn tangent to the surface of the striking face 17 at the sweet spot 17*a* defines a striking face plane 17*b*. Line $L_P$ defines a direction perpendicular to the striking face plane 17*b*. Further, the ball striking face 17 is generally provided with a loft angle $\alpha$, such that at the moment of impact (or at the address position) the ball striking plane 17*b* is not perpendicular to the ground. Generally, the loft angle $\alpha$ determines the initial trajectory of the golf ball at the moment of impact. Rotating the line $L_P$ drawn perpendicular to the striking face plane 17*b* through the negative of the loft angle $\alpha$ defines the desired club-head-trajectory $T_0$ at the moment of impact. Generally, this moment-of-impact club-head-trajectory direction $T_0$ is perpendicular to the longitudinal axis of the club shaft 12. Even further, the line $L_T$, when drawn parallel to the ground, is generally coincident with a direction perpendicular $P_0$ to the moment-of-impact club-head-trajectory direction $T_0$.

The crown 18, which is located on the upper side of the club head 14, extends back from the ball striking face 17 to the rear 22. Further the crown 18 extends across the width of the club head 14, from the heel 24 to the toe 20. The sole 28, which is located on the lower or ground side of the club head 14, extends back from the ball striking face 17 to the rear 22. Further, as with the crown 18, the sole 28 extends across the width of the club head 14, from the heel 24 to the toe 20. The rear 22 is positioned opposite the ball striking face 17, is located between the crown 18 and the sole 28, and extends from the heel 24 to the toe 20.

The heel 24 extends from the ball striking face 17 to the rear 22. For the purposes of the present disclosure, the heel 24 may be generally defined as that portion of the club head 14 that presents a relatively blunt surface when viewed from the shaft side of the club head 14 in a direction perpendicular to the moment-of-impact club-head-trajectory direction $T_0$. The toe 20 extends from the ball striking face 17 to the rear 22 on the side of the club head 14 opposite to the heel 24.

The hosel 16 is located within the hosel region 26. Thus, the hosel region 26 is located at the intersection of the ball striking face 17, the heel 24, the crown 18 and the sole 28 and may encompass those portions that lie adjacent the hosel 16 of each of these features. Generally, the hosel region 26 includes the surfaces that provide a transition from the hosel 16 to the ball striking face 17, the heel 24, the crown 18 and/or the sole 28.

Figure 2:
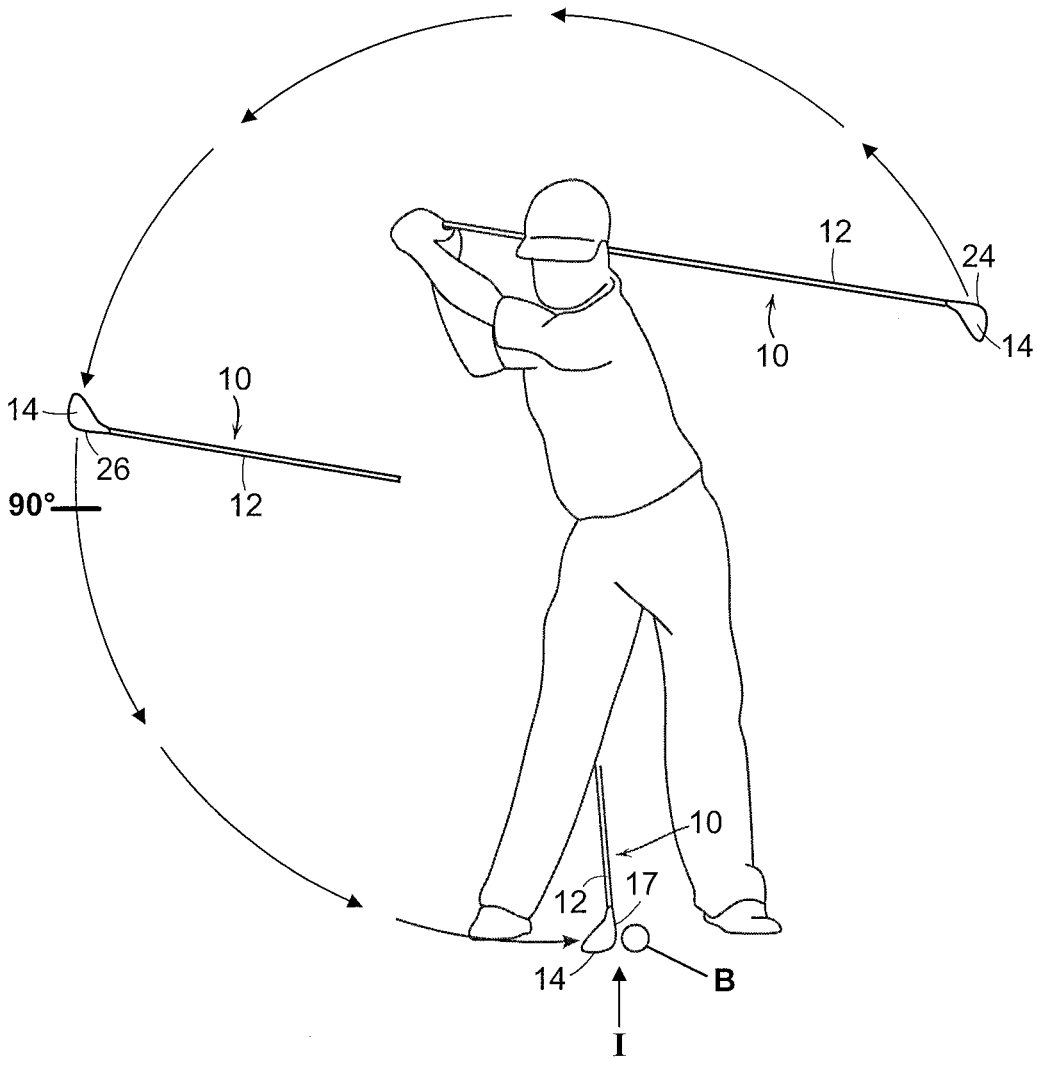
FIG. 2 is a schematic front view of a typical golfer's downswing.

As shown in FIG. 2, at the point of impact (I) with a golf ball (B), the ball striking face 17 may be substantially perpendicular to the direction of travel of club head 14 and the flight of the golf ball. During the user's backswing, the user's rotation of his hips, torso, arms and/or hands causes the golf club 10 to twist such that yaw (defined as rotation around the longitudinal axis of the golf club's shaft 12) is introduced, thereby pivoting the ball striking face 17 out of alignment from its orientation at impact. With the orientation of the ball striking face 17 at the point of impact considered to be 0°, during the backswing the ball striking face 17 twists outwardly away from the user (i.e., clockwise when viewed from above) to a maximum yaw angle of, for example, approximately 130°. Thus, at the beginning of a golfer's downswing, the heel 24 is essentially leading the swing. During the downswing, the orientation of the golf club and club head 14 changes from the 130° of yaw at the beginning of the downswing to the 0° of yaw at the point of impact.

Typically, the change in yaw angle over the course of the downswing is not constant. During the first portion of the downswing, when the club head 14 is above the golfer's waist the change in yaw angle is typically on the order of 20° to 40°. Thus, when the club head 14 is approximately waist high, the yaw is approximately 90° and during the last 90° portion of the downswing (from waist height to the point of impact) the yaw of the golf club generally travels through a angle of about 90° to the yaw of 0° at the point of impact. However, again, the change in yaw angle during this portion of the downswing is not constant, and, in fact, the golf club head 14 typically closes from approximately a 20° yaw to the 0° yaw at the point of impact only over the last 10° degrees of the downswing. In fact, over the course of this latter portion of the downswing, an average change in yaw of 45° to 60° may be typical.

The speed of the golf club head also changes during the downswing, from 0 mph at the beginning of the downswing to 65 to 100 mph (or more, for top-ranked golfers) at the point of impact. At low speed, i.e., during the initial portion of the downswing, drag due to air resistance may not be so significant. However, during the portion of the downswing when club head 14 is even with the golfer's waist and then swinging through to the point of impact, the club head 14 is travelling at a considerable rate of speed (for example, from 60 mph to 140 mph for professional golfers). During this portion of the downswing, drag due to air resistance causes the golf club head 14 to impact the golf ball at a slower speed than would be possible without air resistance.

Figure 3:
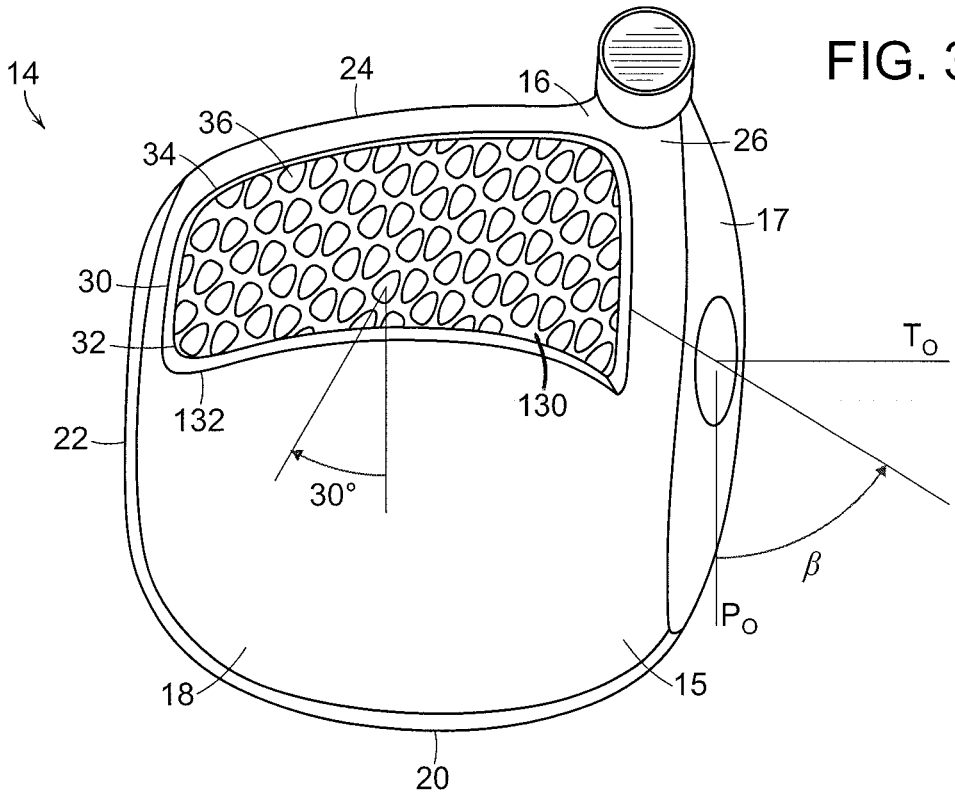
FIG. 3 is a top perspective view of a club head with a drag-reducing structure included on a crown surface of the club head according to another illustrative aspect.

As shown in FIG. 3, a drag-reducing structure 30 is provided on body member 15 in order to reduce the drag on club head 14 during a user's golf swing from the end of a user's backswing through the downswing. Specifically, drag-reducing structure 30 is provided to reduce the drag on club head 14 when the heel 24 and/or the hosel region 26 of the club head 14 are generally leading the swing. As noted above, the phrase "leading the swing" describes that portion of the club head that faces the direction of swing trajectory. Thus, at the moment of impact of the club head 14 with the golf ball, the ball striking face 17 is leading the swing. However, during the initial portion of the forward swing, when the club head 14 is still behind the golfer, and during a significant portion of the downswing, before the moment of impact with the golf ball, ball striking face 17 is not leading the swing. Rather, the heel 24 and/or the hosel region 26 of the golf club head 14 leads the swing during the down stroke. When the heel 24 of the golf club head 14 leads the swing, air flows over the club from the heel area to the toe area, approximately parallel (i.e., within +/−10° to 15°) to the ball striking face 17. When the hosel region 26 of the golf club head 14 leads the swing, air flows from the hosel area across the club head 14 to the toe 20, the rear 22 and/or where the toe 20 and the rear 22 come together. Generally, when the air flows over the club at an angle relative to the perpendicular direction $P_0$ of between approximately 20° to approximately 70°, it is expected that the hosel region 26 of the club head 14 could be considered to lead the swing. At less than approximately 20° from the perpendicular direction $P_0$, the leading surfaces of the heel 24 become more dominant. At more than approximately 70° from the perpendicular direction $P_0$, the leading surfaces of the ball striking face 17 become more dominant. The drag-reducing structure 30 is designed to reduced drag during a significant portion of the downswing of a user's golf swing, not just at the moment of impact.

In certain aspects, drag-reducing structure 30 includes a dimpled surface 32 formed on a surface of club head 14. Air flows in a direction opposite to the golf club head's trajectory over those surfaces of the golf club head 14 that are roughly parallel to the direction of airflow. An important factor affecting drag is the behavior of the air flow's boundary layer. The boundary layer is a thin layer of air that lies very close to the surface. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head 14 (i.e., at the trailing edge as defined relative to the direction of swing trajectory). This low pressure separation region creates pressure drag. The larger the separation region, the larger the pressure drag. Laminar air streams tend to separate from the surfaces sooner than turbulent airstreams, because turbulent air streams can carry (or store) more energy, i.e., that have a greater momentum, than laminar air streams. Thus, one way to delay the separation of the air stream from the surface, and thereby minimize the area of the separation region, is to convert a laminar air stream to a turbulent air stream. Providing a rough surface (i.e. a non-smooth surface) may cause the flow to transition from laminar to turbulent.

The dimpled surface 32 of the drag-reducing structure 30 serves to induce a turbulent air flow over the surface of the golf club head 14, thereby delaying the separation of the air stream from the club's surface. This, in turn, reduces the area of the separation region, thereby reducing drag and improving the aerodynamics of club head 14. The improved aerodynamics of club head 14 results in increased club head speed and the corresponding increase in the distance that the golf ball will travel after being struck.

For purposes of this disclosure, the term "dimple" may refer to either a raised or a lowered, small-scale, surface feature. In other words, a "lowered dimple" may include indentations, pits, depressions, pockmarks and/or other below-surface features. A "raised dimple" may includes bumps, dots, pimples and/or other above-surface features. As used herein, a dimple may be symmetric or unsymmetric, regularly shaped or irregularly shaped, and/or smoothly or sharply departing from the surface surrounding the dimple. A "dimpled surface" may include raised dimples, lowered dimples and/or a combination of raised and lowered dimples.

As illustrated in FIG. 3, a dimpled surface 32 may be provided on the crown 18 of the club head 14 generally in the vicinity of the heel 24. The dimpled surface 32 extends at least partially from the striking face 17 toward the rear 22. As shown in FIG. 3, the dimpled surface 32 may extend substantially completely from the ball striking face 17 to the rear 22 and approximately halfway from the heel 24 to the toe 20. Alternatively, the dimpled surface 32 may extend only partway from the front toward the rear of the golf club head 14. Thus, in certain embodiments, the dimpled surface 32 may extend less than three-quarters of the distance from the striking face 17 toward the rear 22. In other embodiments, the dimpled surface 32 may extend from the striking face 17 less than 60% across the depth of the golf club head 14, less than 50%, less than 40%, less than 30%, less than 25% or even less than 20% across the depth of the golf club head 14.

Similarly, the dimpled surface 32 extends at least partially from the heel 24 toward the toe 20. Generally, the dimpled surface 32 need not extend completely across the crown 18 from the heel 24 to the toe 20. Rather, the dimpled surface 32, as shown in FIG. 3, may extend only partially across the crown 18 of the club head 14, i.e., only part of the distance from the heel 24 to the toe 20. In certain embodiments, the dimpled surface 32 may extend from the heel 24 less than 60% across the width of the golf club head 14, less than 50%, less than 40%, less than 30%, less than 25% or even less than 20% across the width of the golf club head 14.

In the illustrated embodiment of FIG. 3, the dimpled surface 32 may be formed as a plurality of rows 34 of dimples 36. Generally, rows 34 may be defined as a regular (or quasi-regular) linear array of dimples 36, wherein the spacing between the dimples 36 within a row 34 is equal to or less than a spacing of the dimples 36 across adjacent rows 34. As one example, the dimples 36 may be offset from one another within a row 34, so long as the offsets overlap in the direction of the linear array. Alternatively, the dimples 36 may be irregularly or randomly spaced or placed on the surface(s) of the club head 14.

The dimples 36 need not be any particular shape, size, aspect ratio, height or depth. Nor need all of the dimples 36 have the same shape, size, aspect ratio, height or depth. By way of non-limiting examples, advantageous shapes may include circles, squares, hexagons, ovals, ellipsoids, diamonds, rectangles, teardrops, crescents or other elongated or non-elongated shapes (including, both regular and irregular shapes). Thus, for example, as shown in FIG. 3, the dimples may be described as elongated trapezoids with rounded corners.

Some or all of the dimples 36 may be configured to have an elongated axis. This elongated axis may be referred to as a "major axis." A "minor axis" may be defined as the dimension of the dimple measured perpendicular to the major axis. For certain example structures, the elongated axis of dimples 36 may extend at an angle of from approximately 5° to approximately 85° relative to a direction parallel to the moment-of-impact club-head-trajectory direction $T_0$. As shown in the embodiment of FIG. 3, the elongated axis of the dimples 36 may be oriented along approximately a 30° clockwise angle (i.e., within +/−5° from a direction perpendicular $P_0$ to the moment-of-impact club-head-trajectory direction $T_0$ (i.e., a 120° angle from a direction parallel to the moment-of-impact club-head-trajectory direction $T_0$. By way of non-limiting examples, advantageous orientations of the elongated axes of the dimples 36 may range from approximately 10° to approximately 80°, from approximately 15° to approximately 75°, from approximately 20° to approximately 70°, from approximately 30° to approximately 60°, or even from approximately 40° to approximately 70°, from a perpendicular to the moment-of-impact club-head-trajectory direction $T_0$.

Not all of the dimples 36 associated with any particular drag-reducing structure 30 need be elongated. Further, the orientation of the major axis of any dimples 36 that are elongated may vary within any particular drag-reducing structure 30. For certain example embodiments, at least a majority of the dimples 36 forming a dimpled surface 32 may have a major axis aligned at a non-zero angle to the moment-of-impact club-head-trajectory direction $T_0$.

According to certain aspects, the size of the dimples 36 need not be constant. By way of non-limiting examples, advantageous sizes of the dimples 36 may have widths and/or lengths ranging from approximately 0.5 mm to approximately 3.0 mm, from approximately 1.0 mm to approximately 2.5 mm, or even from approximately 1.5 mm to approximately 2.0 mm. Thus, widths and/or lengths greater than approximately 0.5 mm may be desirable, and widths and/or lengths less than approximately 3.0 mm may be desirable. The widths and lengths of the dimples need not be constant. By way of non-limiting examples, the dimples 36 may have maximum depths and/or maximum heights that range from approximately 0.05 mm to approximately 1.0 mm. For certain embodiments it may be desirable for the dimples 36 to have maximum depths and/or maximum heights that range from approximately 0.05 mm to approximately 0.20 mm, from approximately 0.10 mm to approximately 0.50 mm, or even from approximately 0.10 mm to approximately 0.8 mm. Depths and/or heights greater than approximately 0.20 mm may be desirable, and depths and/or heights less than approximately 0.8 mm may be desirable. Further, the depths and/or heights of the dimples 36 also need not be constant. For example, the depths and/or heights of the dimples 36 may gradually increase and then decrease in depth along the width dimensions and/or along the length dimensions of the dimples 36. Other shapes, sizes, heights and/or depths for the individual dimples would be apparent to persons of ordinary skill in the art, given the benefit of this disclosure.

The rows 34 may extend at an angle relative to the ball striking surface 17. In other words, rows 34 may be oriented at a non-zero angle β relative to the direction perpendicular $P_0$ to the direction of the trajectory of the club head at the moment-of-impact $T_0$. For example, in the embodiment of FIG. 3, the rows 34 extend along approximately a 60° angle (counterclockwise) from a direction perpendicular $P_0$ to the trajectory of the club head at the moment-of-impact. The rows 34 may have a varying number of dimples 36. Further, neighboring dimples 36 within each of the rows 34 may be aligned or they may be slightly offset from each other (as shown in FIG. 3). Even further, rows 34 need not be parallel to one another. For example, the angle β for successive rows could increase as the distance to the hosel 16 increases. Optionally, rows 34 could be slightly curved, for example, to accommodate the surface geometry or curvature of the crown 18 or the sole 28.

Figure 4:
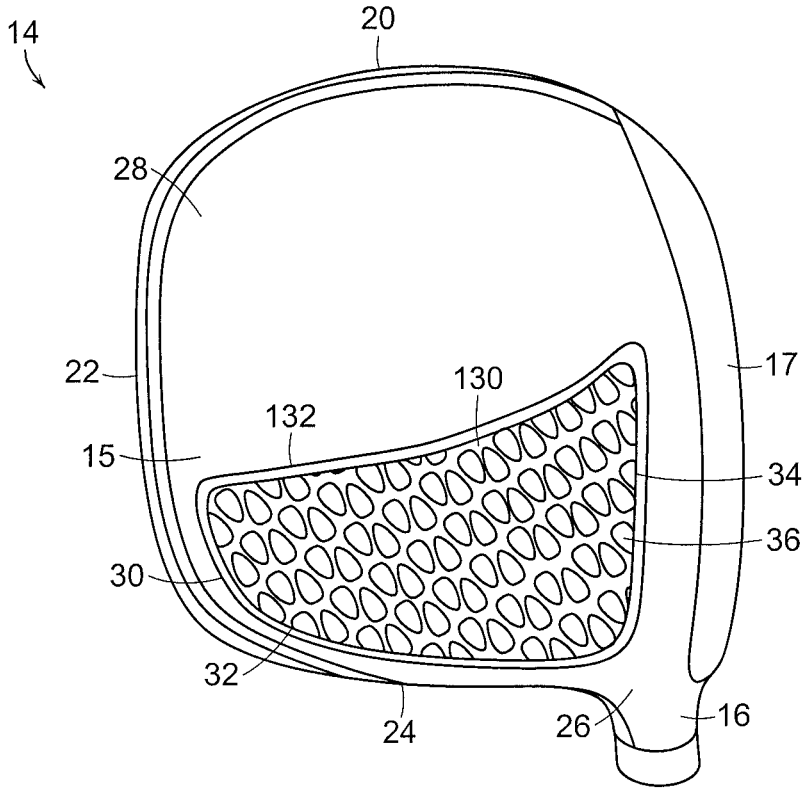
FIG. 4 is a bottom perspective view of a club head with a drag-reducing structure included on a sole surface of the club head according to even another illustrative aspect.

As illustrated in FIG. 4, the dimpled surface 32 may be provided on the sole 28 of the club head 14 generally in the vicinity of the heel 24. The dimpled surface 32 may extend from the striking face 17 at least partially toward the rear 22. As shown in FIG. 4, the dimpled surface 32 may extend substantially completely from the ball striking face 17 to the rear 22 and approximately halfway from the heel 24 to the toe 20. Alternatively, the dimpled surface 32 may extend only partway from the front toward the rear of the golf club head 14. Thus, in certain embodiments, the dimpled surface 32 may extend less than three-quarters of the distance from the striking face 17 toward the rear 22. In certain other example embodiments, the dimpled surface 32 may be provided on the crown 18 and/or the sole 28 starting a predetermined distance away from the striking face 17. By way of non-limiting examples, the dimpled surface 32 may extend less than 60% across the depth of the golf club head 14, less than 50%, less than 40%, less than 30%, less than 25% or even less than 20% across the depth of the golf club head 14.

Similarly, the dimpled surface 32 may extend from the heel 24 at least partially toward the toe 20. Generally, the dimpled surface 32 does not extend completely across the sole 28 from the heel 24 to the toe 20. Rather, the dimpled surface 32, as shown in FIG. 4, may extend only partially across the sole 28 of the club head 14, i.e., only part of the distance from the heel 24 to the toe 20. In certain other example embodiments, the dimpled surface 32 may be provided on the crown 18 and/or the sole 28 starting a predetermined distance away from the heel 24. By way of non-limiting examples, the dimpled surface 32 may extend less than 60% across the width of the golf club head 14, less than 50%, less than 40%, less than 30%, less than 25% or even less than 20% across the width of the golf club head 14.

In other example structures according to this disclosure, the dimpled surface 32 may be provided on the crown 18 and/or the sole 28 starting a predetermined distance away from the hosel region 26. Thus, air flowing over the hosel region 26 of the club head 14, when the hosel region 26 leads the swing, may be laminar, with the transition to a turbulent flow regime being delayed until the dimpled surface 32 on the crown 18 and/or sole 28 is reached.

Referring back to FIG. 1, as a non-limiting example, a first drag-reducing structure 30*a* may be provided on the crown 18 of the club head 14 and a second drag-reducing structure 30*b* may be provided on the hosel region 26. The first drag-reducing structure 30*a* is generally provided with rows 34 of elongated dimples 36. However, for this particular example, the row closest to the hosel region 26 is provided with round, non-elongated dimples. The second drag-reducing structure 30*b* is generally provided with elongated dimples 36 which are not arranged in rows. Even further, the orientation of the major axis of the elongated dimples is not constant for the dimples in the second drag-reducing structure 30*b*.

Figure 5:
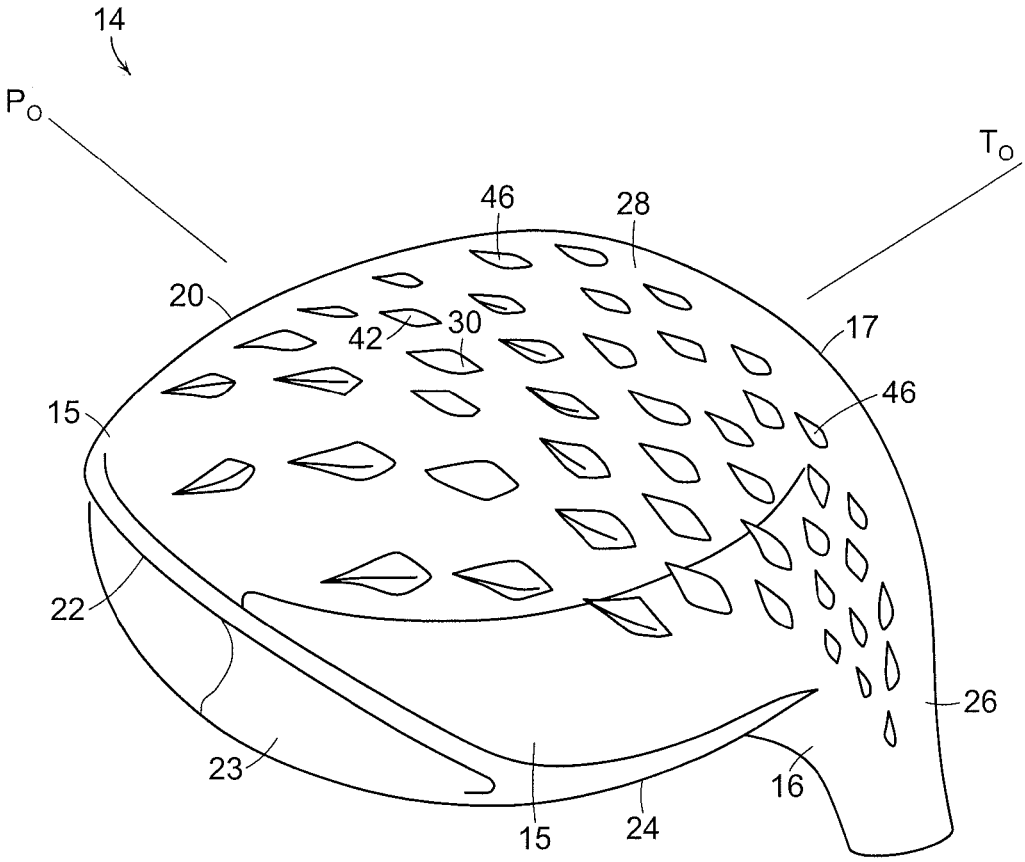
FIG. 5 is a perspective view of a club head with a drag-reducing structure included on a hosel region surface and on a sole surface of the club head according to a further illustrative aspect.

According to certain aspects, as illustrated in FIG. 5, the drag-reducing structure 30 includes the dimpled surface 42 formed on surfaces of the club head 14. As illustrated in FIG. 5, the dimpled surface 42 is provided on a lower surface of the hosel region 26 and on the sole 28 of the club head 14. The dimpled surface 42 extends across a majority of the width of the sole 28 (i.e., from the heel 24 to the toe 20). Further, the dimpled surface 42 extends across a majority of the depth of the sole 28 (i.e., from ball striking face 17 to the rear 22). Compared to the dimpled surfaces 32 of FIGS. 3 and 4, the dimples 46 of the dimpled surface 42 are much more widely spaced. Further, the dimples 46 are provided as elongated, roughly diamond-shaped cuts in the surface of the sole 28. Alternatively, the dimpled surface 42 need not extend across the width of the club head 14 all the way to the toe 20. Further, the dimpled surface 42 need not extend across the depth of the club head 14 to the rear 22. In certain embodiments (not shown), the dimpled surface 42 may extend from the hosel region 26 over at least a third of the distance from the heel 24 to the toe 20 and no more than half of the distance from the heel 24 to the toe 20. In other embodiments, the dimpled surface 42 may extend from the hosel region 26 over at least a third of the distance from the striking face 17 to the rear 22 and no more than half of the distance from the striking face 17 to the rear 22.

In the example structure of FIG. 5, the dimples 42 are not necessarily arranged in rows, but rather may be more randomly and/or irregularly dispersed. Further, the major axes (i.e., the elongated dimension) of the dimples 46 need not all have the same alignment. Thus, some of the dimples 46 are aligned at approximately 45° relative to a direction perpendicular $P_0$ to the moment-of-impact club-head-trajectory direction $T_0$, thereby extending generally from the hosel region 26 to the intersection of the toe 20 with the rear 22. Others of the dimples 46 are aligned at approximately 5° (counterclockwise as viewed in FIG. 5) relative to the perpendicular direction $P_0$, thereby extending generally from the hosel region 26 to the toe 20; while others of the dimples 46 are aligned at approximately 60° (counterclockwise as viewed in FIG. 5) relative to the perpendicular direction $P_0$, thereby extending generally from the hosel region 26 to the midpoint of the rear 22. Thus, it can be seen that not all of the dimples 46 need be oriented the same way. By way of non-limiting examples, the major axis of the dimples 46 may be aligned at an angle from the direction perpendicular $P_0$ to the moment-of-impact club-head-trajectory direction $T_0$ that ranges from approximately 0° to approximately 80°, from approximately 10° to approximately 70°, from approximately 15° to approximately 60°, from approximately 30° to approximately 60°, from approximately 40° to approximately 70°, or even from approximately 40° to approximately 60° from the perpendicular $P_0$ (when measured counterclockwise as viewed in FIG. 5). Further, the dimples 46 are shown in FIG. 5 as having varying sizes, ranging from smaller dimples in the hosel region 26 to larger dimples toward the center of the sole 28.

As further illustrated in FIG. 5, the club head 14 may include various other structures, such as groove 23, which may also provide a drag reducing effect. The groove 23 may extend partially or fully along the length of the rear 22. Optionally, groove 23 may extend partially or fully along the length of the toe 20 (not shown). As another example, groove 23 may extend at least partially along the length of the toe 20, around the intersection of the toe 20 with the rear 22, and then further extend at least partially along the length of the rear 22.

The dimples 36 and 46 may be provided on the surface(s) of the club head 14 by any suitable method, including stamping, milling, cutting, forging, casting, molding, etc. Optionally, for ease of manufacture and referring back to FIGS. 3 and 4, the drag-reducing structure 30 may be provided as an insert or medallion 130 seated within a holder or receptacle 132. Medallion 130 may be formed by any suitable method, including stamping, milling, cutting, forging, casting, molding, etc. and of any suitable material, including metals, plastics, composites, ceramics, etc. Further, medallion 130 may be removably or permanently placed within receptacle 132. Interchangeable medallions 130 may be configured for receipt by any particular receptacle 132. Additionally, one or more receptacles 132 may be formed in the crown 18 and/or the sole 28 in order to receive one or more medallions 130.

Figure 6A:
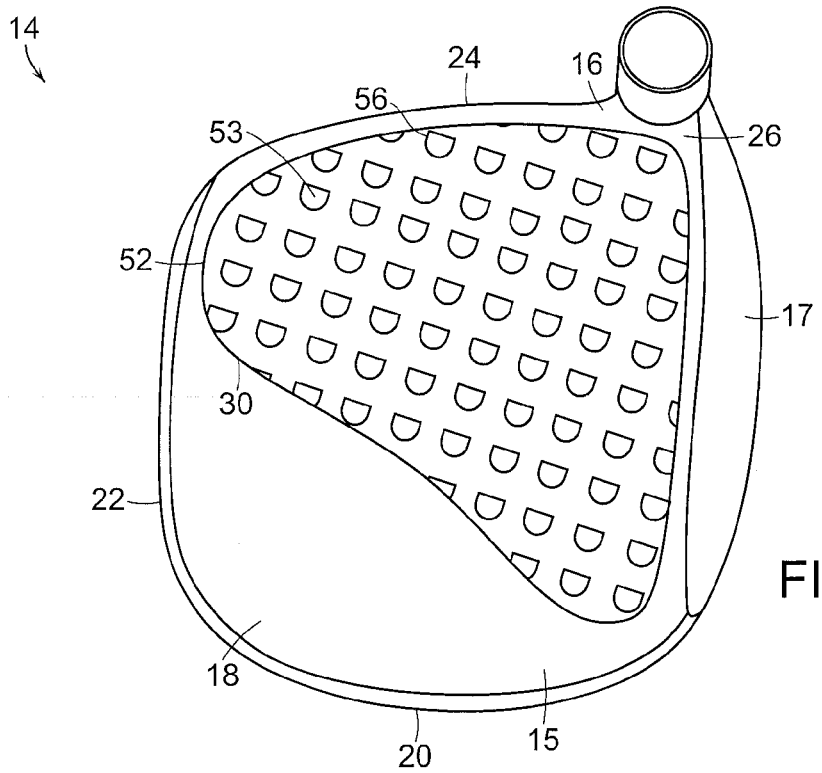
FIG. 6A is a top perspective view of a club head with a drag-reducing structure having lowered dimples included on a crown surface of the club head according to another illustrative aspect.
Figure 6B:
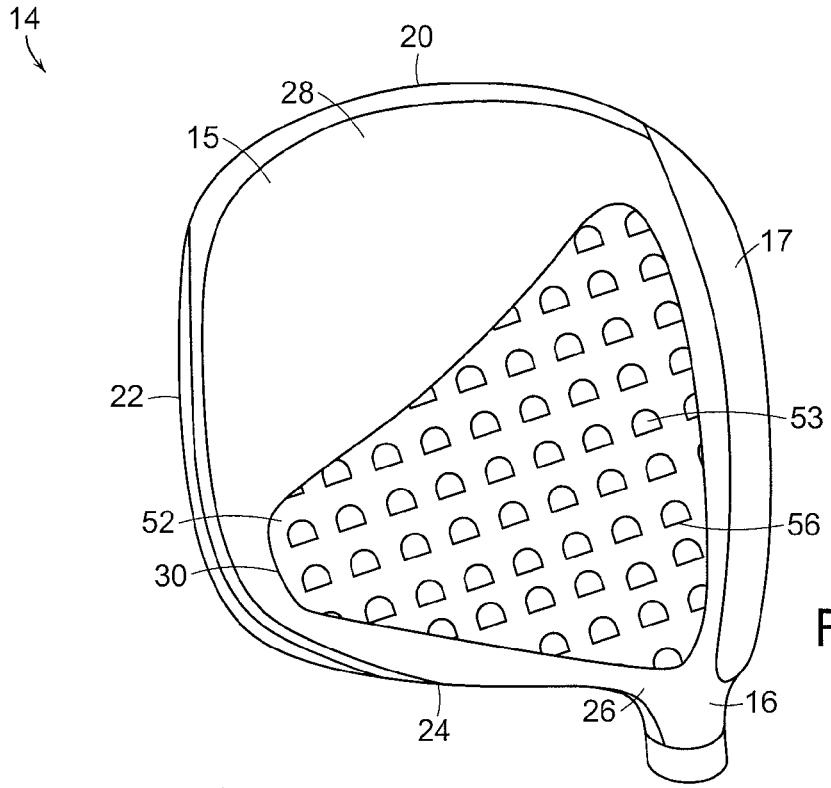
FIG. 6B is a bottom perspective view of the club head of FIG. 6A with a drag-reducing structure having lowered dimples included on a sole surface.

According to other aspects, as generally illustrated in FIGS. 6A and 6B, drag-reducing structures 30 may be provided on both the crown 18 (see FIG. 6A) and the sole 28 (see FIG. 6B) as coatings or laminates 52 applied to the surfaces of the club head 14. In this particular embodiment, drag-reducing structure 30*a* (see FIG. 6A) is provided by a coating 52*a* having a plurality of holes 53, which function as dimples 56 when the coating 52 is applied to the surface of the club head 14. Thus, in this particular embodiment, the depth and/or height of the dimples 56 may be the same as the thickness of the coating 52. The coating may be provided as a film, such as a perforated or punched vinyl wrap (e.g., FastSkinz™ wrap), or as a spray-on or otherwise deposited layer. Given the ease with which films may be stamped and/or applied, providing the drag-reducing structure 30 by applying a film to the surfaces of the club head 14 may allow for a greater variety of dimple shapes and dimple patterns.

Figure 7A:
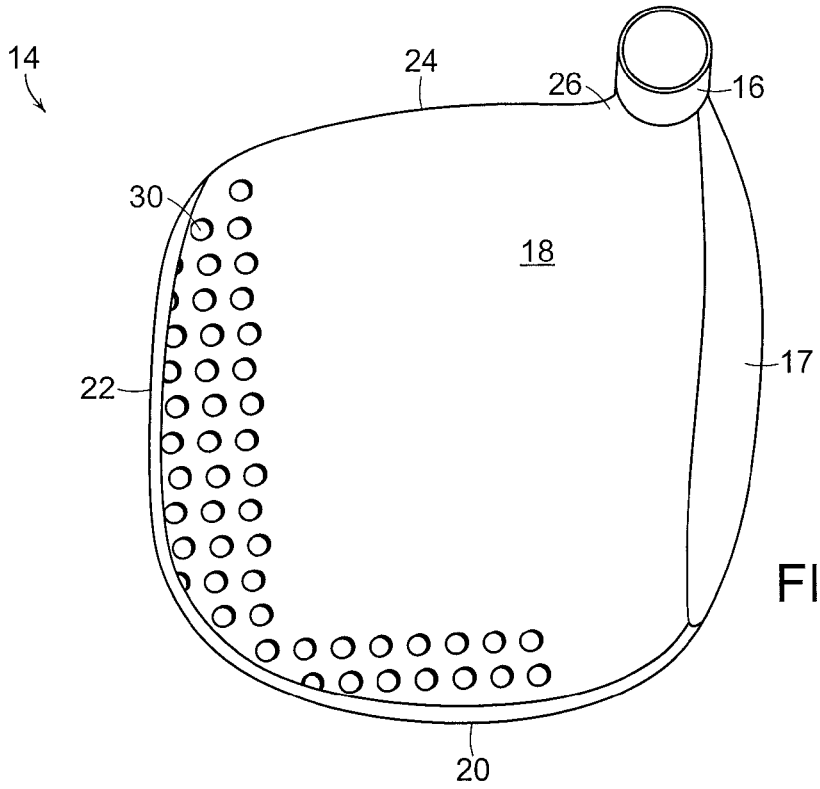
FIG. 7A is a top perspective view of a club head with a drag-reducing structure having raised dimples included on a crown surface of the club head according to another illustrative aspect.
Figure 7B:
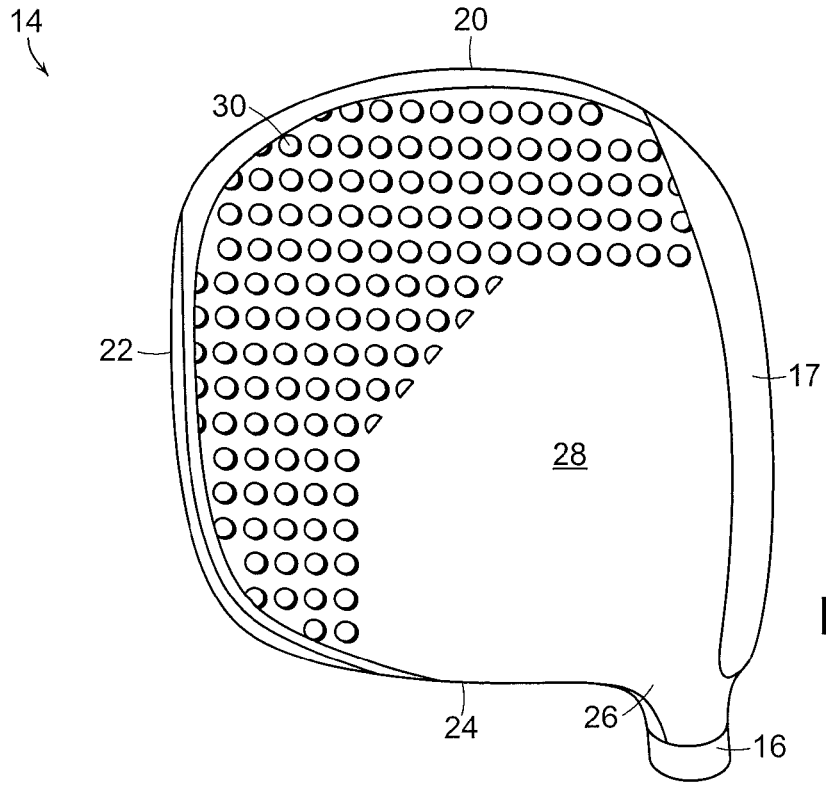
FIG. 7B is a bottom perspective view of a club head with a drag-reducing structure having raised dimples included on a sole surface of the club head according to another illustrative aspect.

In general, the drag-reducing structure 30 may be provided on the crown 18, on the sole 28, on the heel 24, and/or on the hosel region 26. Having the drag-reducing structure 30 configured for air flowing generally from the hosel region 26 may be particularly advantageous, since for the majority of the swing path of the golf club 10, the leading portion of the club head 14 may be the hosel region 26, with the trailing edge of the club head 14 being the toe 20 and/or the intersection of the toe 20 with the rear 22, as noted above. Thus, an aerodynamic advantage may be provided by locating the drag-reducing structure 30 relatively close to the hosel region 26 may be realized during the majority of the downswing path. In particular, it may be expected that the aerodynamic advantage provided by locating the drag-reducing structure 30 relatively close to the hosel region 26 would be most strongly realized during the latter portion of the downswing, i.e., that last 90° of the downswing as the club head 14 is building momentum prior to impacting the golf ball. Alternatively, referring to FIGS. 7A and 7B, an aerodynamic advantage may be realized by providing the drag-reducing structure 30 relatively close to the trailing edge of the club head 14. For example, it may be expected that locating the drag-reducing structure 30 on the sole 28 and/or the crown 18 adjacent to the toe 20, to the rear 22, and/or to the intersection of the toe 20 with the rear 22 may allow laminar flow across the majority of the surface of the sole 28 that is only triggered into turbulent flow close to the trailing edge of the club head 14. Even further, an aerodynamic advantage may be realized by providing a dimpled surface 32 over a majority of the surfaces of the crown, the sole and the heel. According to certain aspects, dimples 32 may be provided over the entire surfaces of the crown, the sole, the heel, the toe, the hosel region and/or the rear. Thus, for example, every surface but the ball striking face 17 may be covered with a dimple surface 32.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body member having a ball striking face, a crown, a toe, a heel, a sole, a rear and a hosel region located at the intersection of the ball striking face, the heel, the crown and the sole; and a plurality of elongated dimples located on the crown, wherein at least some of the plurality of the crown dimples have a major axis that is not aligned in a direction parallel to the moment-of-impact club-head-trajectory direction, and further wherein at least some of the plurality of crown dimples have a major axis dimension ranging from approximately 0.5 mm to approximately 3.0 mm and a maximum width dimension, perpendicular to the major axis dimension, that ranges from approximately 0.5 mm to approximately 3.0 mm.

2. The golf club head of claim 1, wherein at least some of the plurality of crown dimples are located adjacent the heel.

3. The golf club head of claim 1, wherein at least some of the plurality of crown dimples have a major axis that is not aligned in a direction perpendicular to the moment-of-impact club-head-trajectory direction.

4. The golf club head of claim 1, wherein the major axes of at least a majority of the crown dimples are not aligned in a direction parallel to the moment-of-impact club-head-trajectory direction.

5. The golf club head of claim 1, wherein at least some of the plurality of crown dimples have a major axis that is aligned at an angle of from approximately 15 degrees to approximately 75 degrees relative to a direction parallel to the moment-of-impact club-head-trajectory direction.

6. The golf club head of claim 1, wherein at least some of the plurality of crown dimples have a major axis that is aligned at an angle of from approximately 40 degrees to approximately 70 degrees relative to a direction parallel to the moment-of-impact club-head-trajectory direction.

7. The golf club head of claim 1, wherein at least some of the plurality of crown dimples have a major axis that is aligned at an angle of from approximately 40 degrees to approximately 60 degrees relative to a direction parallel to the moment-of-impact club-head-trajectory direction.

8. The golf club head of claim 1, wherein at least some of the plurality of crown dimples are lowered dimples having a maximum depth dimension that ranges from approximately 0.05 mm to approximately 1.0 mm.

9. The golf club head of claim 1, wherein at least some of the plurality of crown dimples are raised dimples having a maximum height dimension that ranges from approximately 0.05 mm to approximately 1.0 mm.

10. The golf club head of claim 1, further including a plurality of dimples on the sole, wherein at least some of the plurality of sole dimples have a major axis that is not aligned in the direction parallel to the moment-of-impact club-head-trajectory direction.

11. The golf club head of claim 1, further including a plurality of dimples on the hosel region, wherein at least some of the plurality of hosel region dimples have a major axis that is not aligned in the direction parallel to the moment-of-impact club-head-trajectory direction.

12. The golf club head of claim 1, further including a plurality of dimples on the heel, wherein at least some of the plurality of heel dimples have a major axis that is not aligned in the direction parallel to the moment-of-impact club-head-trajectory direction.

13. The golf club head of claim 1, further including a groove extending at least partially along the length of the toe.

14. The golf club head of claim 1, further including a groove extending at least partially along the length of the rear.

15. The golf club head of claim 1, further including a groove extending at least partially along the length of the toe, extending at least partially along the length of the rear, and extending across an intersection of the toe with the rear.

16. A golf club head comprising:

a body member having a ball striking face, a crown, a toe, a heel, a sole, a rear and a hosel region located at the intersection of the ball striking face, the heel, the crown and the sole; and a plurality of elongated dimples located on the sole, wherein at least some of the plurality of the sole dimples have a major axis that is not aligned in a direction parallel to the moment-of-impact club-head-trajectory direction, and further wherein at least some of the plurality of sole dimples have a major axis dimension ranging from approximately 0.5 mm to approximately 3.0 mm and a maximum width dimension, perpendicular to the major axis dimension, that ranges from approximately 0.5 mm to approximately 3.0 mm.

17. The golf club head of claim 16, wherein the major axes of at least some of the plurality of sole dimples are not aligned in a direction perpendicular to the moment-of-impact club-head-trajectory direction.

18. The golf club head of claim 16, wherein at least some of the plurality of sole dimples have a major axis that is aligned at an angle of from approximately 15 degrees to approximately 75 degrees relative to the direction parallel to the moment-of-impact club-head-trajectory direction.

19. The golf club head of claim 16, wherein at least some of the dimples are lowered dimples having a maximum depth dimension that ranges from approximately 0.05 mm to approximately 1.0 mm.

20. The golf club head of claim 16, wherein at least some of the dimples are raised dimples having a maximum height dimension that ranges from approximately 0.05 mm to approximately 1.0 mm.

21. A golf club head comprising:

a body member having a ball striking face, a crown, a toe, a heel, a sole, a rear and a hosel region located at the intersection of the ball striking face, the heel, the crown and the sole; and a plurality of elongated dimples located in the hosel region, wherein at least some of the plurality of hosel region dimples have a major axis that is not aligned in a direction parallel to the moment-of-impact club-head-trajectory direction, and further wherein at least some of the plurality of hosel region dimples have a major axis dimension ranging from approximately 0.5 mm to approximately 3.0 mm and a maximum width dimension, perpendicular to the major axis dimension, that ranges from approximately 0.5 mm to approximately 3.0 mm.

22. The golf club head of claim 21, wherein the major axes of at least some of the plurality of hosel region dimples are not aligned in a direction perpendicular to the moment-of-impact club-head-trajectory direction.

23. The golf club head of claim 21, wherein the major axes of at least a majority of the hosel region dimples are not aligned in a direction parallel to the moment-of-impact club-head-trajectory direction.

24. The golf club head of claim 21, wherein at least some of the plurality of hosel region dimples have a major axis that is aligned at an angle of from approximately 15 degrees to approximately 75 degrees relative to the direction parallel to the moment-of-impact club-head-trajectory direction.

25. The golf club head of claim 21, wherein at least some of the hosel region dimples are lowered dimples having a maximum depth dimension that ranges from approximately 0.05 mm to approximately 1.0 mm.

26. The golf club head of claim 21, wherein at least some of the hosel region dimples are raised dimples having a maximum height dimension that ranges from approximately 0.05 mm to approximately 1.0 mm.

27. A golf club head comprising:

a body member having a ball striking face, a crown, a toe, a heel, a sole, a rear and a hosel region located at the intersection of the ball striking face, the heel, the crown and the sole; and a plurality of elongated dimples located on the heel, wherein at least some of the plurality of the heel dimples have a major axis that is not aligned in a direction parallel to the moment-of-impact club-head-trajectory direction, and further wherein at least some of the plurality of heel dimples have a major axis dimension ranging from approximately 0.5 mm to approximately 3.0 mm and a maximum width dimension, perpendicular to the major axis dimension, that ranges from approximately 0.5 mm to approximately 3.0 mm.

28. The golf club head of claim 27, wherein the major axes of at least some of the plurality of heel dimples are not aligned in a direction perpendicular to the moment-of-impact club-head-trajectory direction.

29. The golf club head of claim 27, wherein at least some of the plurality of heel dimples have a major axis that is aligned at an angle of from approximately 15 degrees to approximately 75 degrees relative to the direction parallel to the moment-of-impact club-head-trajectory direction.

30. The golf club head of claim 27, wherein at least some of the heel dimples are lowered dimples having a maximum depth dimension that ranges from approximately 0.05 mm to approximately 1.0 mm.

31. The golf club head of claim 27, wherein at least some of the heel dimples are raised dimples having a maximum height dimension that ranges from approximately 0.05 mm to approximately 1.0 mm.

32. A golf club comprising:

a shaft; and a golf club head having a ball striking face, a crown, a toe, a heel, a sole, a rear and a hosel region located at the intersection of the ball striking face, the heel, the crown and the sole; and a plurality of elongated dimples located on the sole, wherein at least some of the plurality of sole dimples have a major axis that is not aligned in a direction parallel to a moment-of-impact club-head-trajectory direction, and further wherein at least some of the plurality of crown dimples have a major axis dimension ranging from approximately 0.5 mm to approximately 3.0 mm and a maximum width dimension, perpendicular to the major axis dimension, that ranges from approximately 0.5 mm to approximately 3.0 mm, and wherein the golf club head is secured to a first end of the shaft.

* * * * *